United States Patent [19]

Shepherd

[11] Patent Number: 4,880,151

[45] Date of Patent: Nov. 14, 1989

[54] PRESSURIZED SPRAY PAINT CONTAINER

[76] Inventor: Willard W. Shepherd, 3500 Shepherd St., Los Angeles, Calif. 90022

[21] Appl. No.: 264,830

[22] Filed: Oct. 31, 1988

[51] Int. Cl.[4] ..... B65D 6/34

[52] U.S. Cl. ..... 222/394; 222/464; 220/DIG. 13; 220/66

[58] Field of Search ..... 222/143, 463, 394, 464, 222/211, 382, 162, 173; 220/DIG. 13, 66; 215/1 R, 12.1; 239/337, 340

[56] References Cited

U.S. PATENT DOCUMENTS

| | | | |
|---|---|---|---|
| 2,090,334 | 8/1937 | Paasche | 239/337 |
| 3,490,656 | 1/1970 | Taschner | 222/464 X |
| 3,705,689 | 12/1972 | Lee | 239/337 |
| 4,765,515 | 8/1988 | Lippman | 222/162 |
| 4,782,945 | 11/1988 | Geiler et al. | 215/12.1 X |
| 4,787,514 | 11/1988 | Shepherd | 222/173 |

FOREIGN PATENT DOCUMENTS

| | | | |
|---|---|---|---|
| 97076 | 9/1960 | Norway | 220/66 |

OTHER PUBLICATIONS

Aerosol Age, Aug. 1973, p. 8, "French Development Signals near-Empty Can".

*Primary Examiner*—Kevin P. Shaver
*Assistant Examiner*—Gregory L. Huson
*Attorney, Agent, or Firm*—Harris, Kern, Wallen & Tinsley

[57] ABSTRACT

A pressurized spray paint container having a spray control nozzle at the top with an internal transport tube attached to the nozzle and extending to the bottom of the container. The container bottom is bulged outward so that the container cannot be rested on its bottom, but rather must be stored generally horizontal whereby the paint solids in the container are away from the inner end of the tube.

1 Claim, 1 Drawing Sheet

PRESSURIZED SPRAY PAINT CONTAINER

BACKGROUND OF THE INVENTION

This invention relates to pressurized spray paint containers, and in particular to a new and improved container configuration for controlling the handling of such containers.

A typical pressurized spray paint container comprises a cylindrical can with a top and a bottom. A spray control nozzle is mounted in the top, and a transport tube is positioned within the container. The outlet end of the transport tube is connected to the control nozzle and the inlet end of the tube terminates adjacent the bottom. The container is charged with a mixture of paint solids, paint solvent, and a propellant.

In use, the container is shaken to mix the paint solids and paint solvent and then the spray control nozzle is manually depressed, with the container in a generally upright position. Depressing the nozzle opens a flow path from the interior of the container up through the transport tube and out the spray nozzle, with the propellant forcing the paint solvent/solid mixture out the nozzle.

During storage, the paint solids settle at the bottom of the container. Sometimes a metal ball is included within the container to aid in mixing the paint solids and solvent when the container is shaken.

Pressurized spray paint containers of the type described above have been generally available and widely used for many years. However there is a problem with this product, which problem has been in existence since the pressurized spray paint container was first available, and which problem has not been satisfactorily resolved. When a container is stored for any period of time, the paint solids settle to the bottom and some of the solids enter the inlet end of the transport tube, particularly after the container has been used in a painting operation. Once the paint solids harden in the transport tube, the container is no longer usable since it is nearly impossible to clean the hardened solids from the transport tube by agitation. This necessitates discarding the container with its still usable charge of propellant and paint.

SUMMARY OF THE INVENTION

It is an object of the present invention to provide a new and improved pressurized spray paint container in order to overcome the problem of the plugged transport tube within the container and the resultant waste of otherwise usable pressurized spray paint containers.

In the present invention, the container i constructed so that such containers must be stored, shipped and displayed in a controlled position with the container axis at an angle to the vertical so that the paint solids are away from the inlet end of the transport tube. Typically the container is maintained with its axis generally horizontal, but other orientations are also usable.

The container of the invention comprises a pressurized spray paint container having a generally cylindrical configuration about the container axis with a top and a bottom, a spray control nozzle at the top end of the container, and a transport tube positioned within the container and having inlet and outlet ends, with the outlet end connected to the control nozzle, and with the container charged with a mixture of paint solvent, paint solids, and propellant, which paint solids settle in the paint solvent toward the lowestmost portion of the container under the influence of gravity. The bottom of the container is bulged outward so that the container cannot rest on its bottom.

Other objects, advantages, features and results will more fully appear in the course of the following description.

DESCRIPTION OF THE PREFERRED EMBODIMENT

Figure 1:
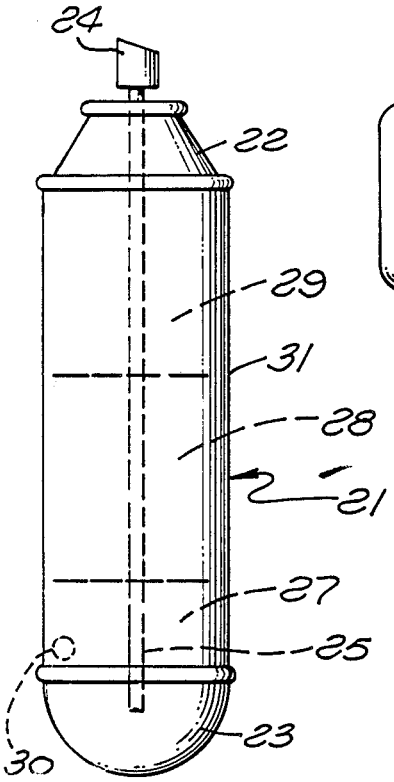
FIG. 1 is a side view of a pressurized spray paint container with the container axis vertical.

The presently preferred embodiment of the pressurized spray paint container is shown in FIG. 1 and comprises a cylindrical can 21 with a top 22 and a bottom 23. A spray control nozzle 24 is mounted in the top 22, and a transport tube 25 is positioned within the container. The outlet end of the transport tube is connected to the control nozzle and the inlet end of the tube terminates adjacent the bottom 23. The container is charged with a mixture of paint solids 27, paint solvent 28, and a propellant 29. Sometimes a metal ball 30 is included within the container to aid in mixing the paint solids and solvent when the container is shaken.

The bottom 23 is bulged outward, which prevents the container being rested on its bottom. The bulged bottom 23 may be formed separate from the central sleeve section 31 or integrally with the sleeve section, as desired, using conventional container manufacturing techniques.

Figure 2:
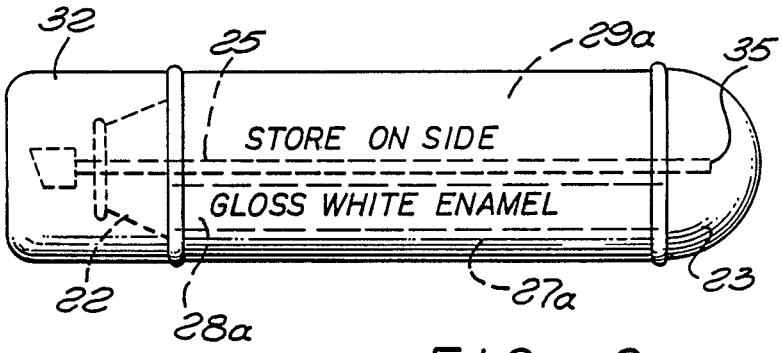
FIG. 2 is a view similar to that of FIG. 1 with the container axis horizontal and with a cover on the container.
Figure 3:
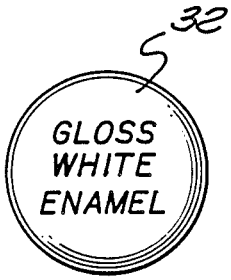
FIG. 3 is a top end view of the container of FIG. 2.

As a result of the bulged bottom 23, the pressurized spray paint container cannot rest in an upright position unless placed in a special package. Hence it is more likely that containers when not in use will be maintained in a controlled position with the container axis at an angle to the vertical, whereby the paint solids in the container are away from the inlet end of the tube. Such an arrangement is illustrated in FIG. 2, with the axis of the cylindrical container horizontal. When the container is stored in this configuration, the paint solids settle along a side wall of the container, as shown at 27*a*. The paint solvent is in a strata above the solids, as indicated at 28*a*, and the propellant is in the upper portion as indicated at 29*a*. With this arrangement, the inlet end 35 of the transport tube 25 is well clear of the paint solids 27*a*.

In FIG. 2, the container is shown with a conventional plastic or metal cover 32 in place over the top 22 and nozzle 24. The legend "STORE ON SIDE" preferably is applied on the side of the container so that it is most easily read when the container is horizontal. The color designation, such as "GLOSS WHITE ENAMEL", preferably is applied in the same manner on the container and on the cover.

Various configurations for racks especially suited for use with the containers of the invention for supporting the container axis at an angle to the vertical, typically horizontal, are shown in the copending application entitled Process and Apparatus for Handling Pressurized Spray Paint Containers, U.S. Ser. No. 07/066,454, filed June 26, 1987 and now U.S. Pat. No. 4,787,514.

Figure 4:
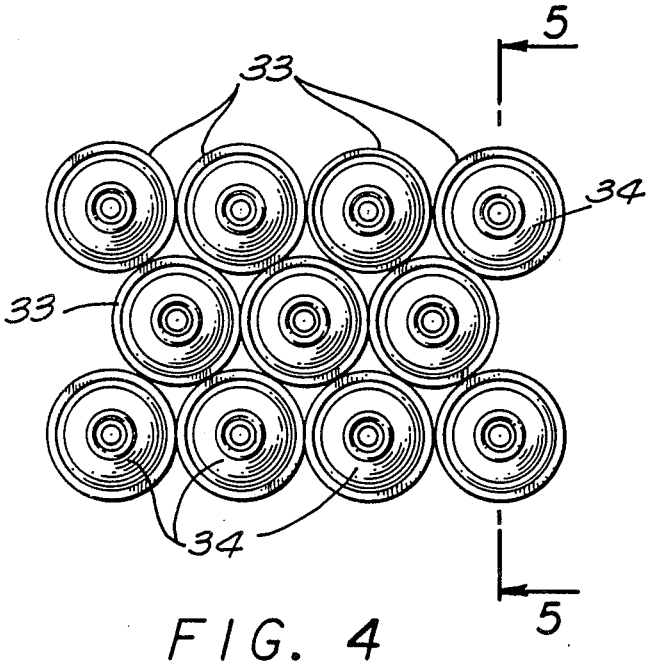
FIG. 4 is an end view of a rack with tubular support units and containers positioned therein.
Figure 5:
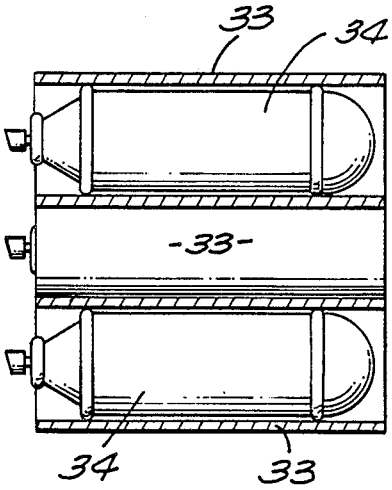
FIG. 5 is a sectional view taken along the line 5—5 of FIG. 4.

An arrangement for storing the containers of the present invention is illustrated in FIGS. 4 and 5 hereof. A number of tubes 33 are joined together in side by side arrangement, typically by cementing or soldering. The tubes may be paper or plastic or metal, as desired. The tubes as illustrated are open at both ends, but may be closed at one end if desired. A cover for the complete assembly of tubes can be used for shipping and/or long term storage if desired.

A pressurized paint spray container 34 is positioned in a tube 33 so that the container is maintained with the container axis horizontal. Also, the top of the container with the spray control nozzle is visible through an open end of the tube and readily permits removal and insertion of a container in a tube. With this arrangement, the container is maintained in the horizontal position at all times except when in use, and the combination is ideally suited for display at retail stores and for storage at work places.

Thus it is seen that the object of the invention is achieved in the container with the bulged bottom, so that the container will not rest on its bottom unaided, while being readily stored with the container axis at an angle to the vertical, maintaining the inlet end of the transport tube away from the paint solids.

I claim:

1. A unitary, non-rechargeable, hand held, self-contained pressurized spray paint container having a generally cylindrical configuration about a container axis with a top and a bottom, a spray control nozzle mounted directly on said container at said top of said container and a transport tube positioned within said container and having inlet and outlet ends, with said outlet end connected to said control nozzle, and with said container charged with a mixture of paint solvent, paint solids, and propellant, which paint solids settle in said paint solvent toward the lowestmost portion of said container under the influence of gravity, with said container having an outwardly bulged bottom so that the container can be operated with one hand for spraying and can be positioned on its side between spraying events and cannot be rested in an upright position on said bottom.

* * * * *